US011751669B2

(12) United States Patent
Sullivan

(10) Patent No.: US 11,751,669 B2
(45) Date of Patent: Sep. 12, 2023

(54) BACKPACK SEAT

(71) Applicant: Kelly Sullivan, Eagle, ID (US)

(72) Inventor: Kelly Sullivan, Eagle, ID (US)

( * ) Notice: Subject to any disclaimer, the term of this patent is extended or adjusted under 35 U.S.C. 154(b) by 191 days.

(21) Appl. No.: 17/080,807

(22) Filed: Oct. 26, 2020

(65) Prior Publication Data

US 2021/0120940 A1 Apr. 29, 2021

Related U.S. Application Data

(60) Provisional application No. 62/925,730, filed on Oct. 24, 2019.

(51) Int. Cl.

| | |
|---|---|
| ***A45F 4/02*** | (2006.01) |
| ***A45B 5/00*** | (2006.01) |
| ***A47C 9/10*** | (2006.01) |

(52) U.S. Cl.

CPC ..... *A45F 4/02* (2013.01); *A45B 5/00* (2013.01); *A47C 9/10* (2013.01); *A45F 2004/026* (2013.01)

(58) Field of Classification Search

CPC ..... A45F 4/02; A45F 2004/026; A45B 5/00; A47C 9/10

See application file for complete search history.

(56) References Cited

U.S. PATENT DOCUMENTS 5,332,283 A * 7/1994 Gray ..... A47C 4/52 297/16.2
5,409,291 A * 4/1995 Lamb ..... A01K 97/22 224/652
5,499,760 A * 3/1996 Pielocik ..... A47C 13/00 224/155
5,819,999 A * 10/1998 Tennant ..... A47C 4/52 224/155
5,954,248 A * 9/1999 Jasper ..... A47C 4/52 224/628
10,028,587 B1 * 7/2018 Kersey ..... A47C 4/52
2002/0113103 A1 * 8/2002 O'Hare ..... A47C 1/146 224/648
2007/0084891 A1 * 4/2007 Gillespie ..... A47C 7/0213 224/155
2007/0205234 A1 * 9/2007 Lessmann ..... A45F 3/04 224/652
2008/0179358 A1 * 7/2008 Redzisz ..... A47C 9/10 224/155
2009/0090751 A1 * 4/2009 D'Alessandro ..... A45F 4/02 224/155
2010/0133303 A1 * 6/2010 Schilly ..... A45F 3/047 224/155
2013/0126564 A1 * 5/2013 Savage, Sr. ..... A45F 4/02 224/155

(Continued)

*Primary Examiner* — Brian D Nash

(57) ABSTRACT

A backpack seat configured for allowing a user to sit in a chair like device while wearing the backpack. The backpack seat includes a tethering system configured for attaching to a backpack. The tethering system includes a plurality of straps that are can be adjustable and configured to attach to a variety of backpacks. A seat is attached to the bottom of the tethering system. At least one receiving cup is attached to the tethering system. The receiving cups are configured for receiving a first support rod and a second support rod. The backpack seat allows a user wearing a backpack to comfortable sit in the seat with the support from the support rods inserted into the receiving cups.

19 Claims, 9 Drawing Sheets

(56) References Cited

U.S. PATENT DOCUMENTS

| | | | | |
|---|---|---|---|---|
| 2014/0076942 | A1* | 3/2014 | Hurt | A45F 3/08 224/155 |
| 2017/0065062 | A1* | 3/2017 | Wang | A45F 3/04 |
| 2018/0110318 | A1* | 4/2018 | Ackerman | A47C 4/52 |
| 2018/0235352 | A1* | 8/2018 | Jones | A41D 15/04 |
| 2020/0253343 | A1* | 8/2020 | Thomas | A47C 9/10 |
| 2020/0260846 | A1* | 8/2020 | Smith | A47C 9/00 |
| 2020/0315327 | A1* | 10/2020 | Jones | A45F 4/02 |
| 2021/0112955 | A1* | 4/2021 | Khan | A45F 3/04 |
| 2022/0170587 | A1* | 6/2022 | Silva | F16M 13/005 |

* cited by examiner

BACKPACK SEAT

PRIORITY/CROSS-REFERENCE TO RELATED APPLICATIONS

This application claims the benefit of U.S. Provisional Application No. 62/925,730, filed Oct. 24, 2019, the disclosure of which is incorporated by reference.

TECHNICAL FIELD

The presently disclosed technology relates generally to portable seating. More specifically, seating used in conjunction with a backpack.

BACKGROUND

Generally, when one is carrying a chair which is often used for various outdoor activities, they are also carrying other items. For example, someone taking a chair to a beach would generally be carrying beach towels, sun screen, a book, and other common beach items. Trying to carry a chair and these other items separately can be extremely burdensome. Accordingly, having a folding chair and backpack combination makes it much more convenient for the user to carry all their equipment.

In the outdoors, hikers or walkers regularly use hiking sticks or trekking poles as a hiking accessory to assist the hiker or walker with their rhythm and to provide stability on rough terrain. Trekking poles are often made in two or three sections and can be extended and retracted as necessary for use and collapsed for storage or transport. When fully retracted, it is possible to attach trekking poles to a backpack.

Most backpacks do not utilize a frame. These backpacks utilize little more than a container of pliant material to which shoulder straps are affixed. Daypacks, knapsacks, book bags, bike bags, and the like, are examples.

On the other hand, general purpose backpacks which are capable of use in carrying heavy, bulky loads typically have an internal or external frame shaped to permit distribution of the load. External frames usually comprise side bars interconnected at their upper and lower ends by cross-members to form a generally rectangular structure. The pack itself is made of pliant material and is suspended from the upper cross-member or the side bars or both cross-member and side bars. In contrast, internal frame packs typically utilize internal structures to provide rigidity to the pack.

What is needed is a seat that a person can use with a backpack to allow a person to easily sit or rest while wearing the backpack. What is further needed is a seat that a person can use with a backpack that allows a person to sit using support rods, such as trekking poles, in lieu of built in chair legs.

SUMMARY OF THE INVENTION

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

What is disclosed is a backpack seat configured for allowing a user to sit in a chair like device while wearing the backpack. The backpack seat includes a tethering system configured for attaching to a backpack. The tethering system includes a plurality of straps that are preferably adjustable and configured to attach to a variety of backpacks. A seat is attached to the bottom of the tethering system. The seat is preferably constructed of a canvas material, a durable lightweight plastic material, a fabric material, or other material commonly used in the art. The backpack seat is preferably lightweight and configured to be easily stored in the backpack.

The tethering system preferably has a lower support panel configured for securing the tethering system to the lower portion or base section of the backpack. The lower support panel prevents the tethering system from sliding off the backpack from the upward force exerted on the tethering system. The lower support panel can be a single strap, a canvas panel, a plastic panel, a nylon strap, or any woven fabric or similar construction known in the art.

The seat preferably has hook and loop fasteners configured for attaching to the lower support panel of the tethering system or base section of the backpack so that the seat can be stored while the user is on the move. The hook and loop fasteners allow the seat to be stored by being attached to the base of the backpack and out of the way of the user.

At least one receiving cup is attached to the tethering system. In a preferred embodiment, a first receiving cup and a second receiving cup are attached to each side of the tethering system such that the receiving cups are positioned on opposing sides of the backpack. In further embodiments, the backpack seat includes more than two receiving cups.

The receiving cups are configured for receiving a first support rod and a second support rod. The support rods are preferably the user's trekking poles typically used by hikers or skip poles used by skiers. Alternatively any stick or rod can be utilized. The backpack seat is configured such that when the tethering system is attached to the backpack, a user can insert a first support rod and a second support rod, such as trekking poles or ski poles, into the receiving cups and sit in the seat attached to the tethering system. The backpack seat distributes the weight of the user and the backpack to the support rods.

In one embodiment, the tethering system is integrated into the backpack. In this embodiment, the receiving cups are attached on opposing sides of the backpack. The seat is attached near or at the base of the backpack.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the description of the preferred embodiments is to be regarded as illustrative in nature, and not as restrictive in nature.

DETAILED DISCLOSURE OF THE EMBODIMENTS

Figure 1:
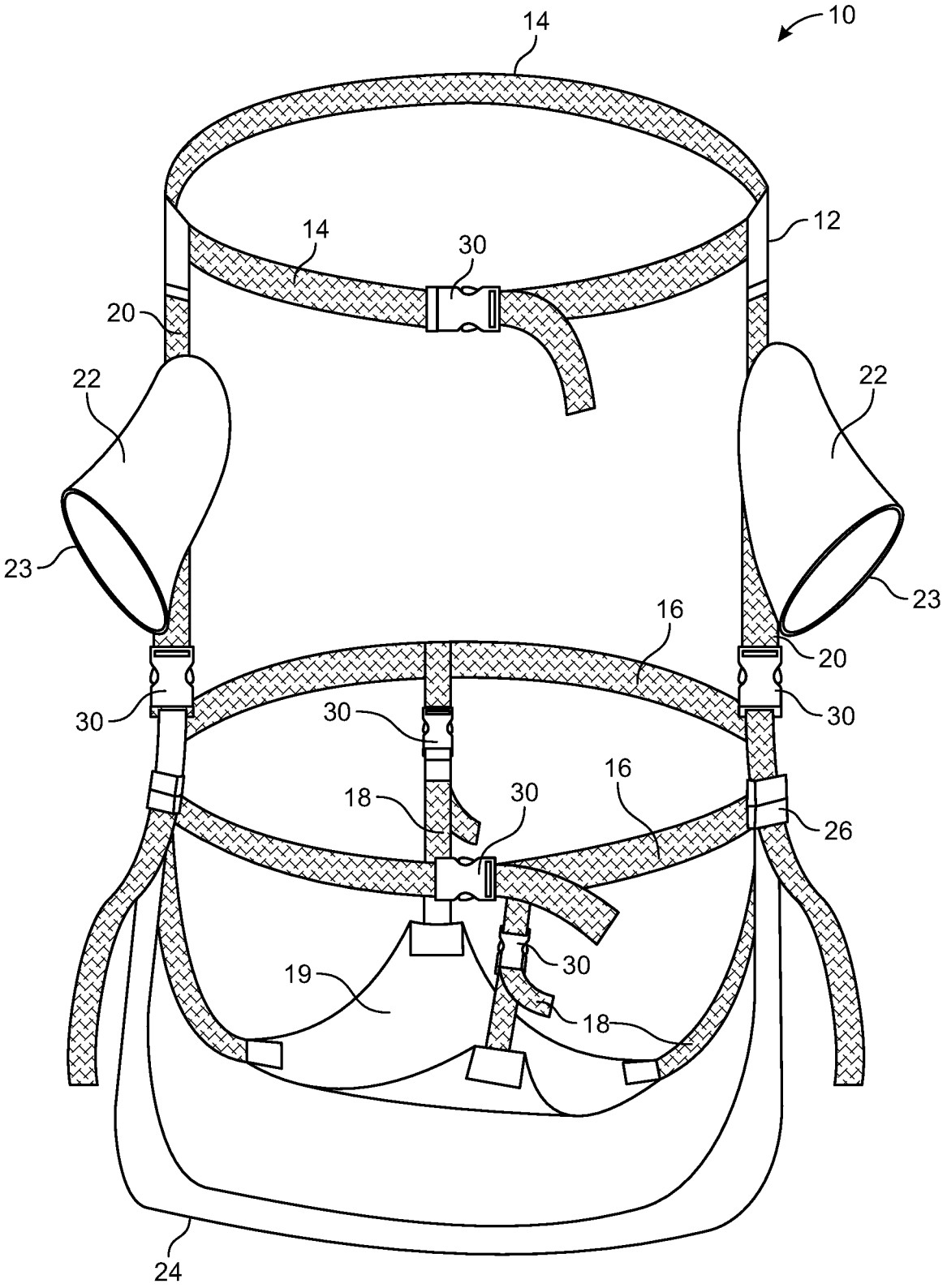
FIG. 1 a rear view of an embodiment of the backpack seat.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

The components include, but are not limited to, a system of tethers configured for attaching any size of backpack, at least one receiving cup, and a seat strap. The receiving cups are configured for holding trekking poles and the receiving cups attach to the sides of the system of tethers to support the backpack and seat.

FIG. 1 illustrates a preferred embodiment of the backpack seat 10. The backpack seat 10 includes a tethering system 12 configured to attach to the backpack seat 10 to a backpack (illustrated in FIGS. 2-9). The tethering system 12 preferably includes a plurality of tethers 14, 16, 18, 20. Top tethers 14 are configured for securing the tethering system 12 to the top of the backpack. Mid tethers 16 are configured for attaching the tethering system 12 to the body of the backpack. Side tethers 20 are configured for securing the top tether 14 to the mid tether 16.

Lower tethers 18 are attached to the mid tethers 14 configured for securing the tethering system 12 to the base of the backpack and to prevent the backpack seat 10 from sliding up and off the backpack. In a preferred embodiment, the lower tethers 18 has a lower support panel 19 for securing the system of tethers to the base of the backpack. The lower support panel 19 preferably has at least four lower tethers 18 configured for securing the backpack seat 10 to the bottom of the backpack. The lower support panel 19 secures the tethering system 12 to a backpack by countering the upward force exerted on the tethering system 12 when the backpack seat 10 is in use. In alternate embodiments, the lower support panel can include a plurality of straps, a single strap, or any construction that can secure the tethering system to the base of the backpack.

In alternate embodiments, fewer tethers can be utilized. For instance, the lower tethers can be directly attached to the top tether. In further alternate embodiments, additional tethers can be utilized to further secure the backpack seat to a backpack.

FIG. 1 further illustrates receiving cups 22 attached to the tethering system 12. The receiving cups 22 are preferably attached to the tethering system 12 on opposing sides for easy access to a user. The receiving cups 22 preferably each have a wide opening 23 configured for receiving support rods such as trekking poles (illustrated in FIGS. 2-4 and 7-9). The receiving cups 22 are preferably are made from a rigid plastic or metal to support a user's body weight. In alternate embodiments, the receiving cups can be fabric, canvas, or a plastic or metal mesh material, to form a sleeve to attach and support trekking poles.

Figure 2:
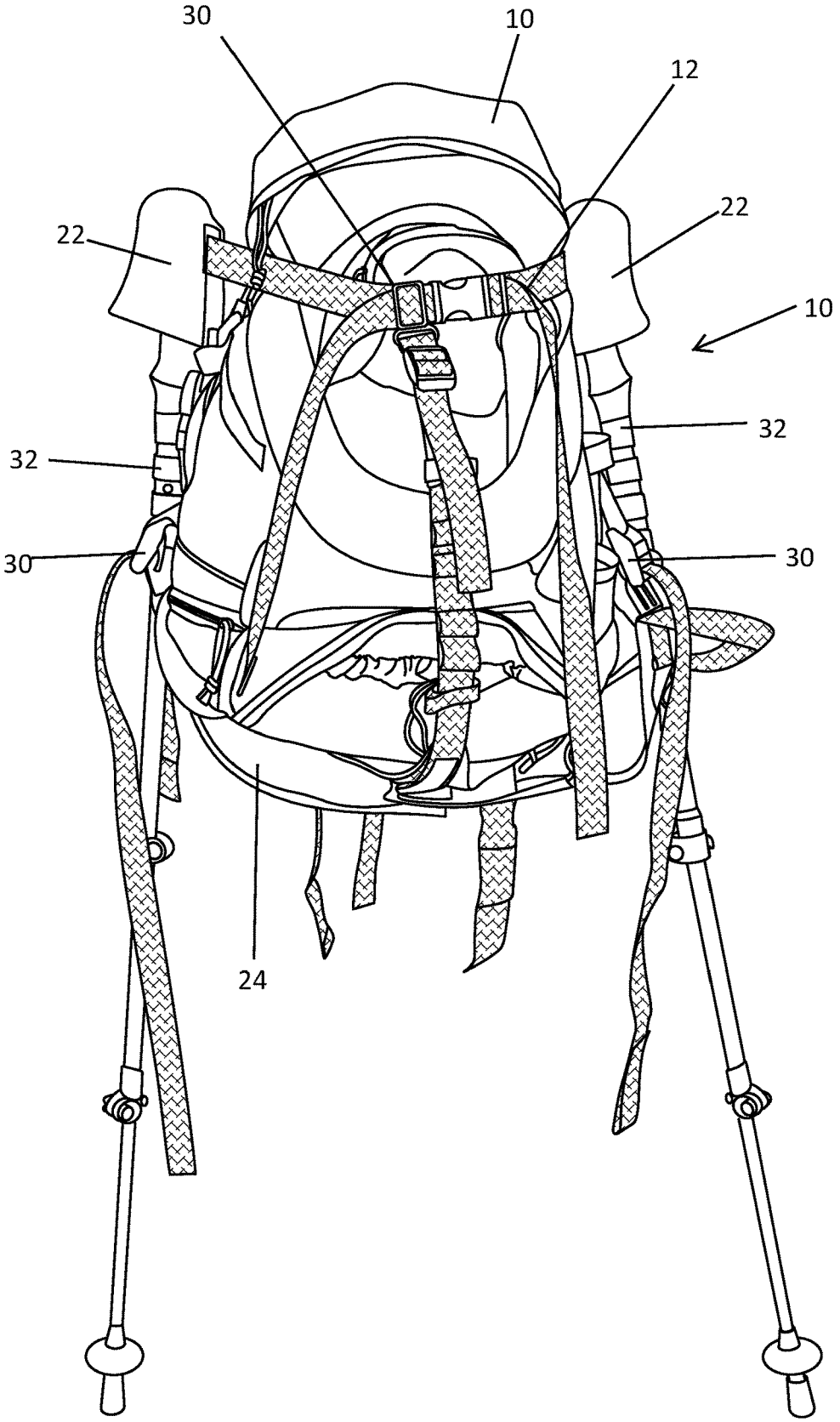
FIG. 2 is a rear view the embodiment of a backpack seat illustrated in FIG. 1 attached to a backpack and trekking poles, with the seat in a retracted position.

A seat 24 is attached to the tethering system 12. The seat 24 is configured for seating a user while the user is wearing the backpack. In a preferred embodiment, the seat strap 24 has hook and loop fasteners (illustrated in FIG. 3) configured to attach the seat to the lower tethers 18 or to the base of the backpack (as shown in FIG. 2). The seat strap 24 preferably attaches to the tethering system 12 via cam strap 26 so that the height of the seat can be adjusted. The seat 24 is preferably small enough to be attached to the base of the backpack or configured to be folded up and stored within the backpack.

The system of tethers preferably includes multiple clips 30 configured for adjusting and attaching the backpack seat 10 to various sized backpacks.

FIG. 2 illustrates the backpack seat 10 attached to a backpack 28. FIG. 2 further illustrates trekking poles 32 inserted into the receiving cups 22. The seat 24 is secured to the lower portion of the tethering system 12 or to the base of the backpack 28.

As illustrated in FIG. 2, the tethering system 12 is adjustable, with a plurality of clips or tabs 30 configured for adjusting the size of the tethering system.

Figure 3:
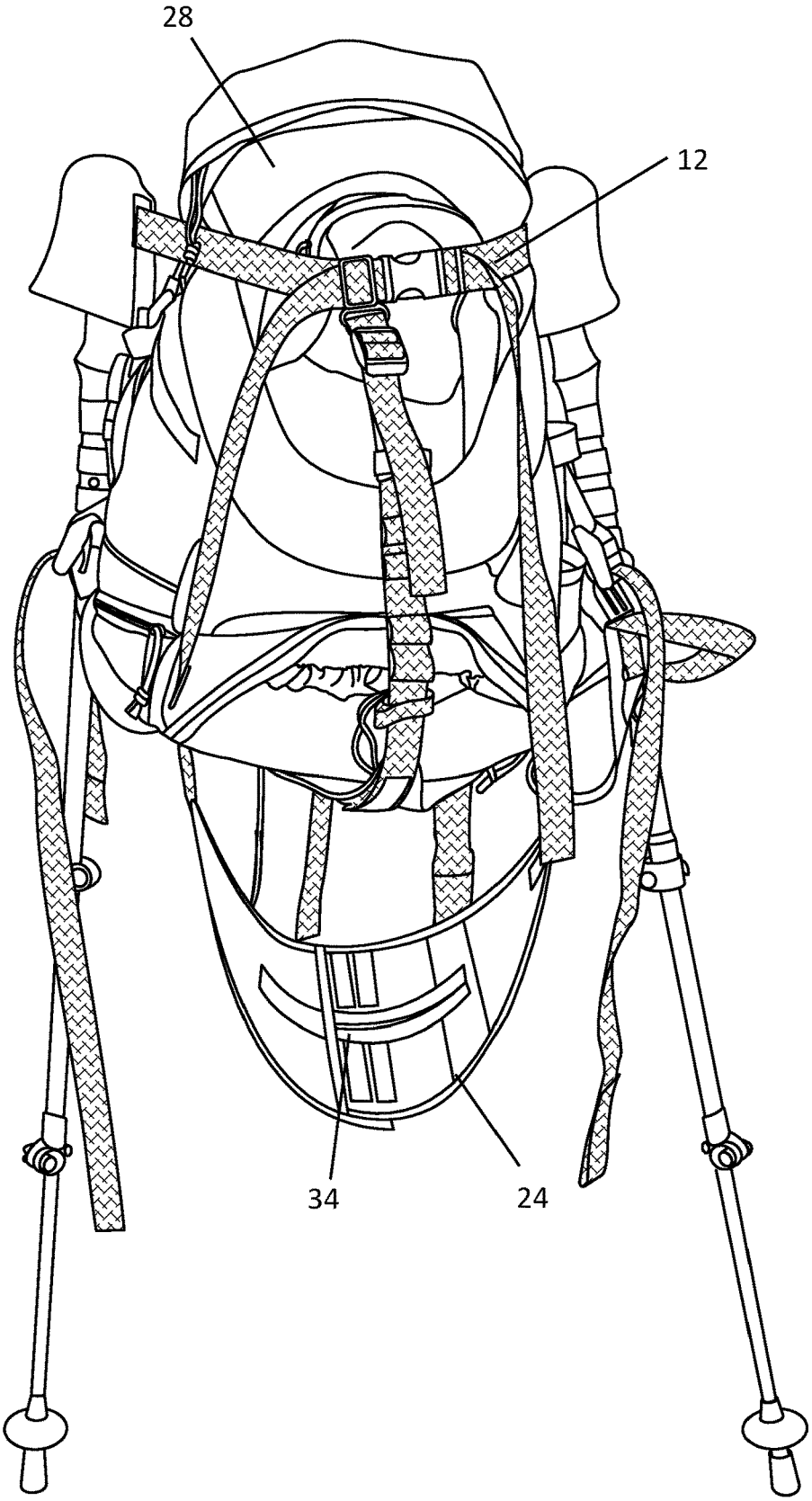
FIG. 3 is a rear view of the embodiment of a backpack seat illustrated in FIGS. 1 and 2 with the seat extended and the backpack seat is attached to a backpack and trekking poles.
Figure 4:
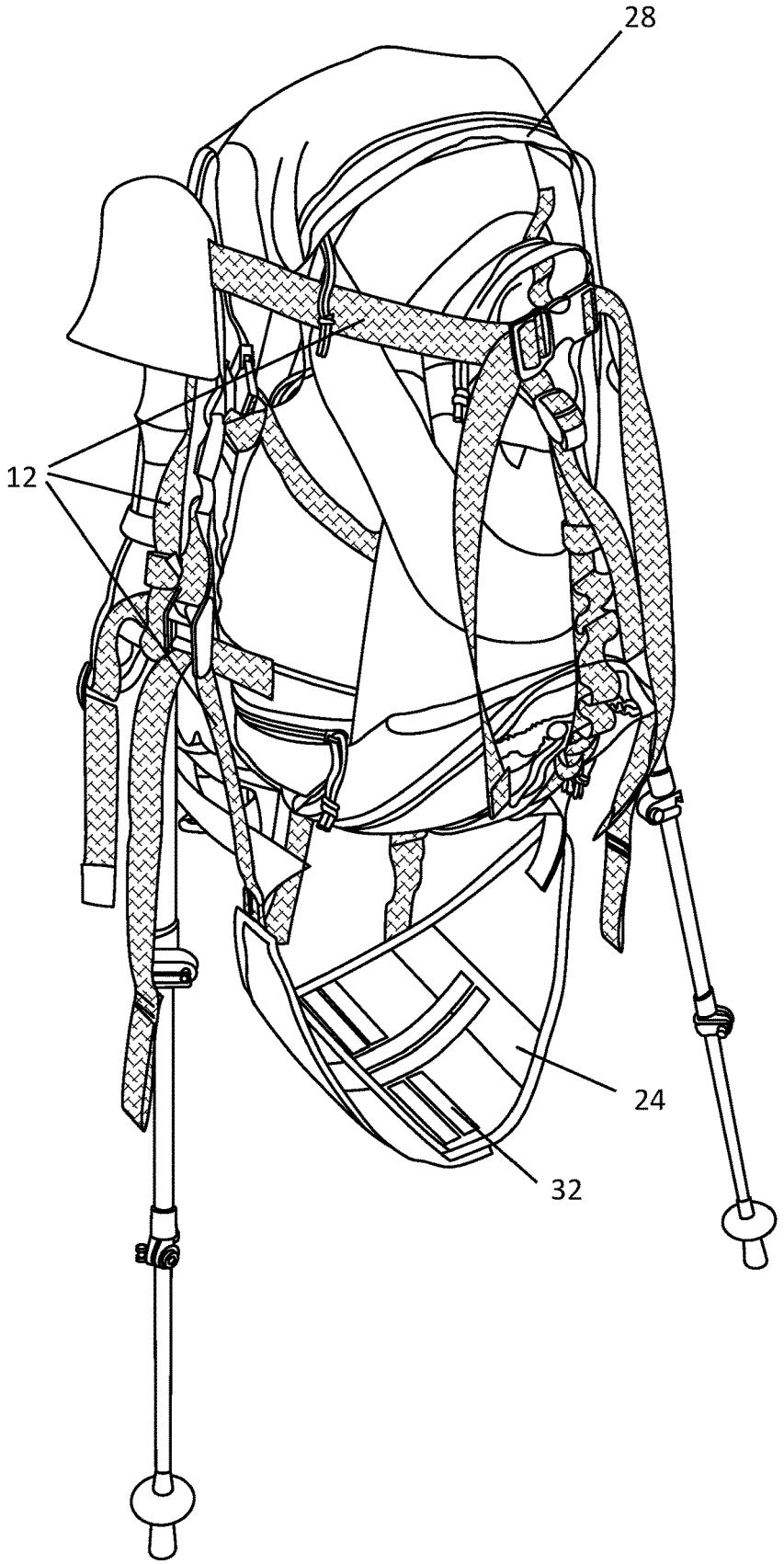
FIG. 4 is a perspective view of the embodiment of a backpack seat illustrated in FIGS. 1-3 with the seat extended and the backpack seat is attached to a backpack and trekking poles.

FIGS. 3-4 illustrate the seat 24 detached from the bottom of the tethering system 12 of the base of the backpack 28. When the seat 24 is detached as illustrated in FIGS. 3-4, a user can position the seat 24 below a user's rear to comfortable sit in the seat 24. FIGS. 3-4 further illustrate the hook and loop fasteners 34 configured for attaching to the base of the backpack or lower end of the tethering system 12.

Figure 5:
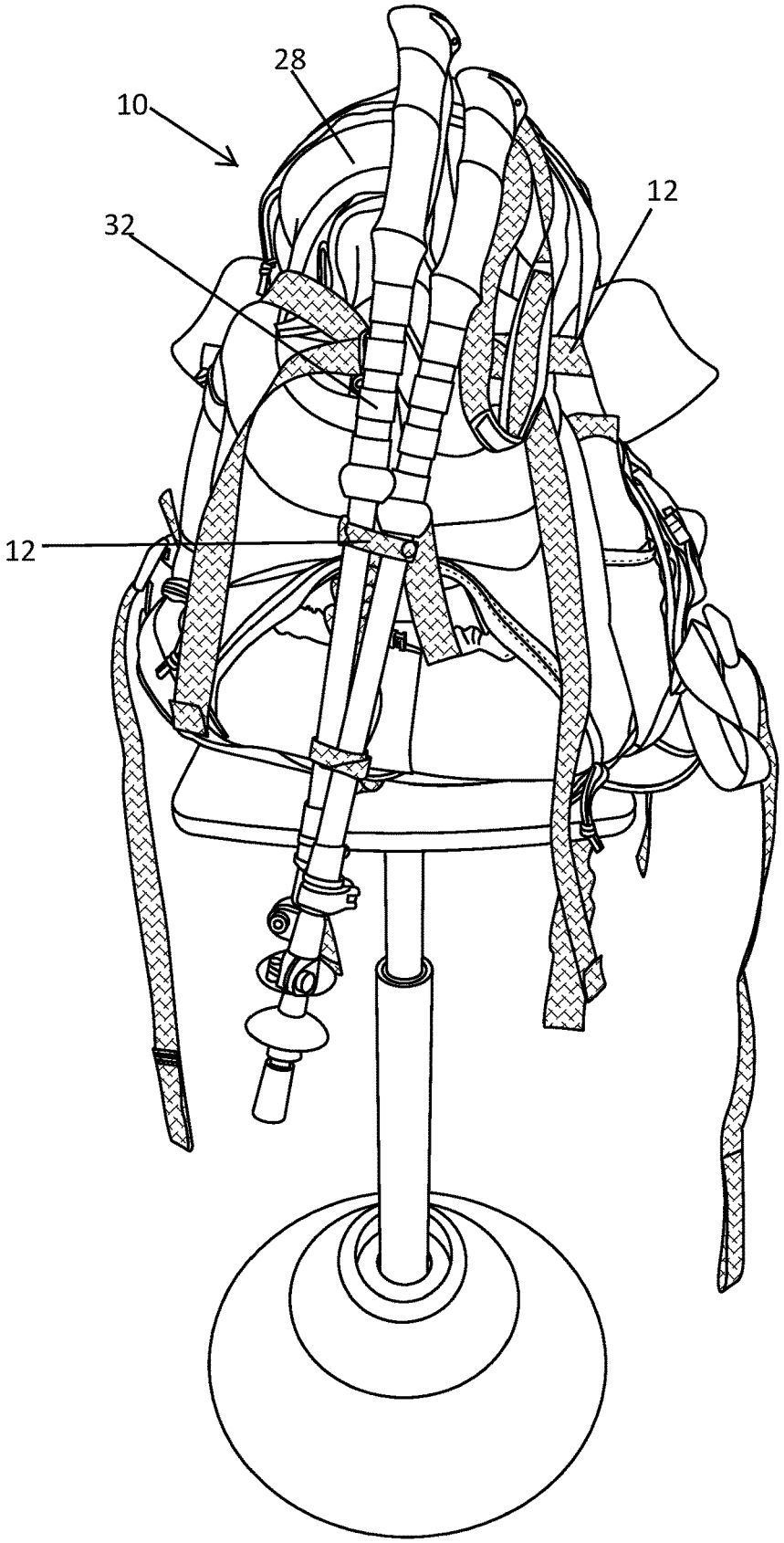
FIG. 5 is a rear view of the backpack seat shown in FIG. 1-4 with the trekking poles mounted on the backpack seat for traveling.

FIG. 5 illustrates the trekking poles 32 attached to the backpack seat 10. The adjustable lengths of the tethering system 12 can be utilized to mount the trekking poles 32 to the backpack 28. Attaching the trekking poles 32 to the backpack allows a user to conveniently pack the trekking poles when they are not in use.

Figure 6:
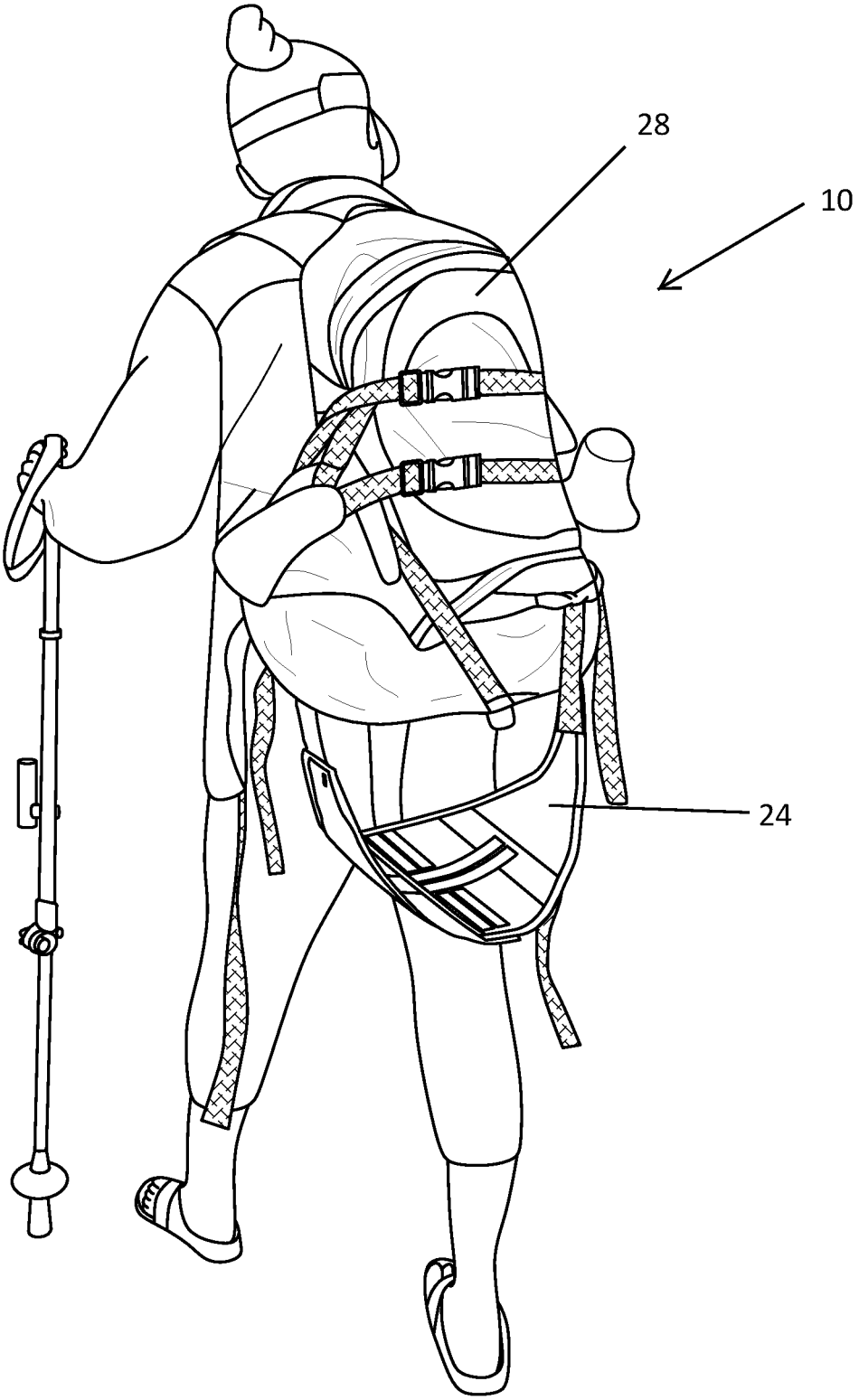
FIG. 6 is perspective view of the embodiment of the backpack seat illustrated in FIG. 1-5 with the backpack worn by a user.

FIG. 6 illustrates a user wearing a backpack 28 with the backpack seat 10. The seat 24 is detached from the base of the backpack.

Figure 7:
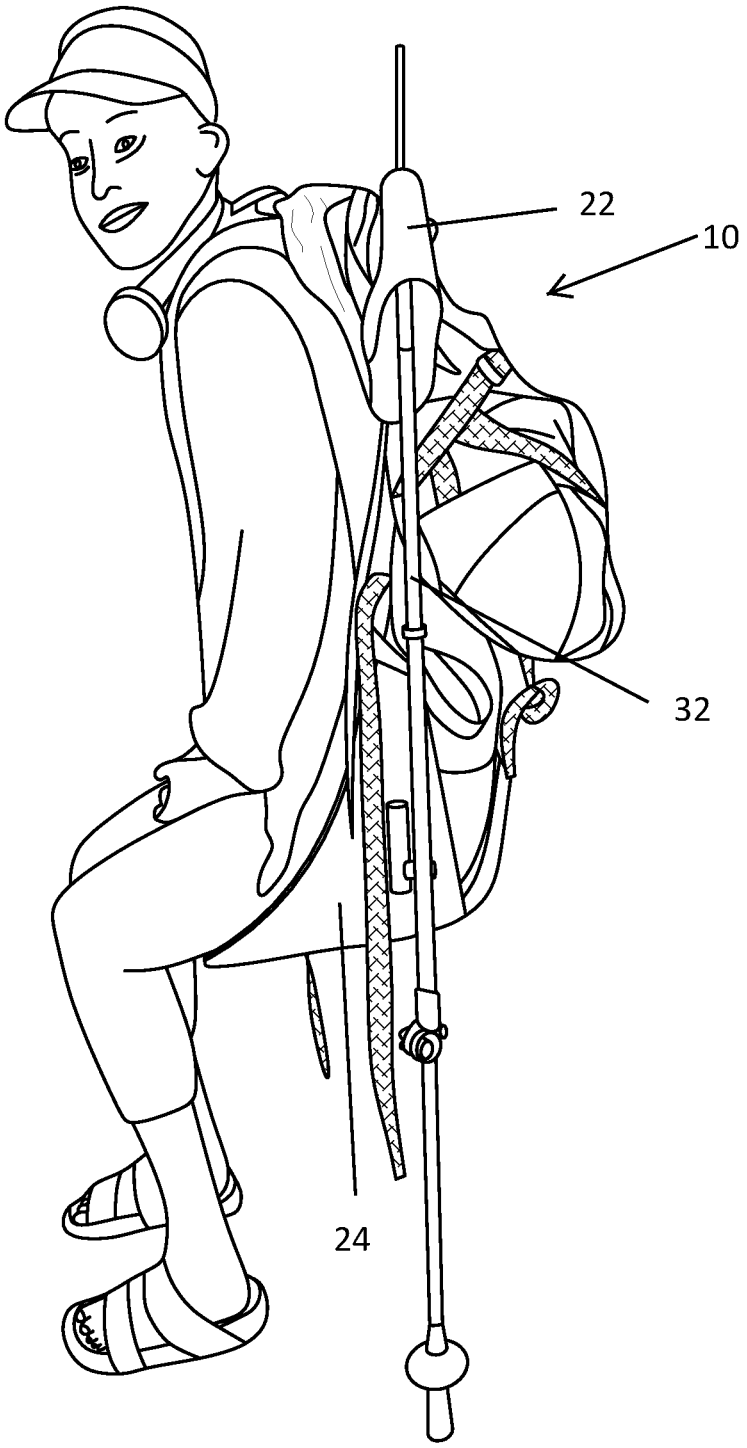
FIG. 7 is a side view of the embodiment of the backpack seat illustrated in FIG. 1-6 with a user sitting in the seat.

FIG. 7 illustrates a user sitting in the seat 24 of the backpack seat 10. The trekking poles 32 are inserted into the receiving cups 22 and support the user's body weight, allowing the user to sit. The trekking poles 32 support the down force of the user sitting on the seat 24. The backpack seat 10 serves to support the weight of the backpack such that the weight is not on the user's back. The backpack seat 10 also servers to support the weight of the user.

Figure 8:
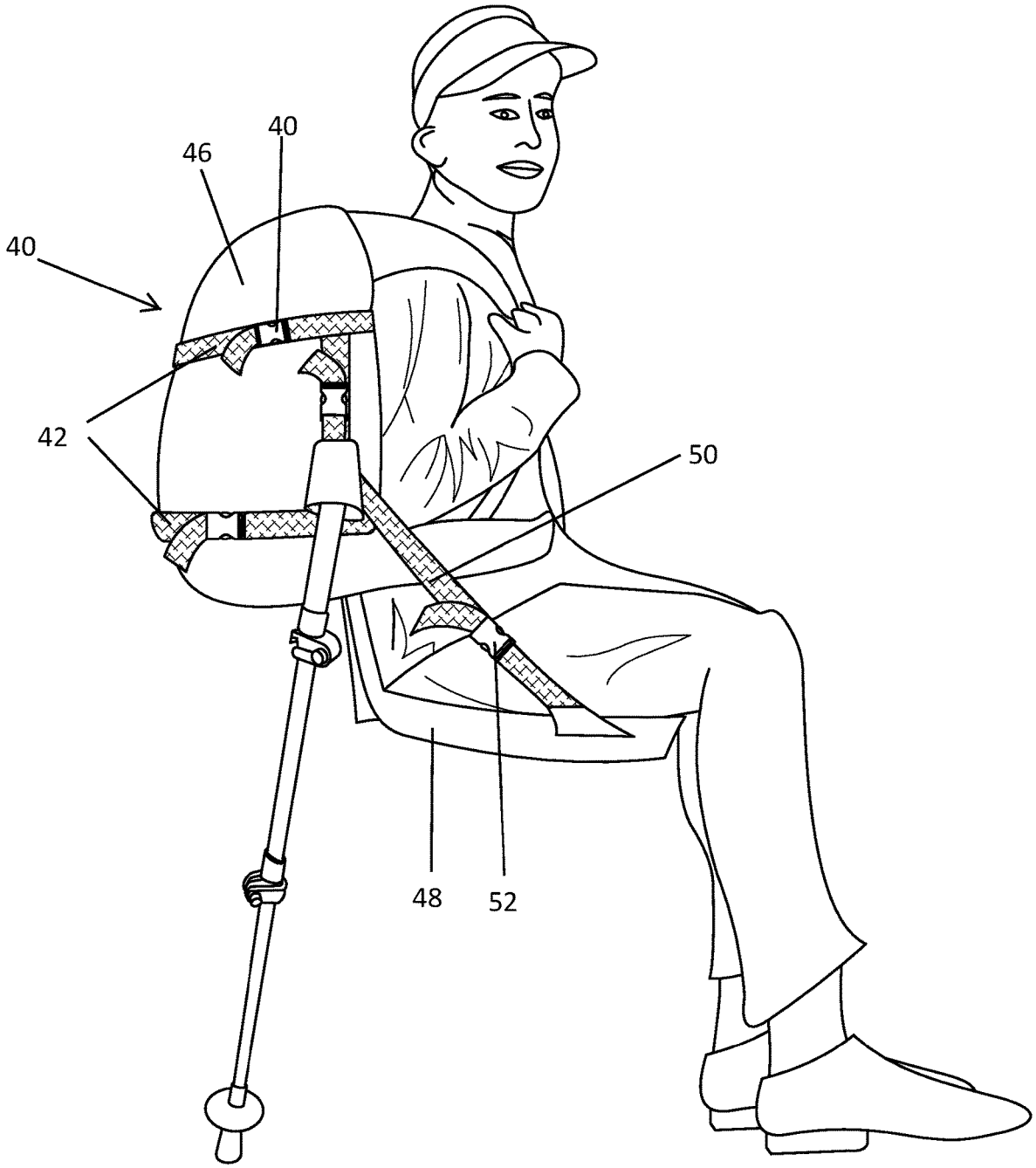
FIG. 8 is a side view of an embodiment of the backpack seat with a user seated in the backpack seat.

FIG. 8 illustrates an alternate embodiment of the backpack seat 40. In this embodiment, the tethering system 42 is substantially integrated into the backpack 46, such as being sewn to the backpack fabric. The clips 44 allow for minor adjustments of the tethering system 42, such that the tethering system 42 can be tightened or loosened depending on the capacity of the backpack 46.

Figure 9:
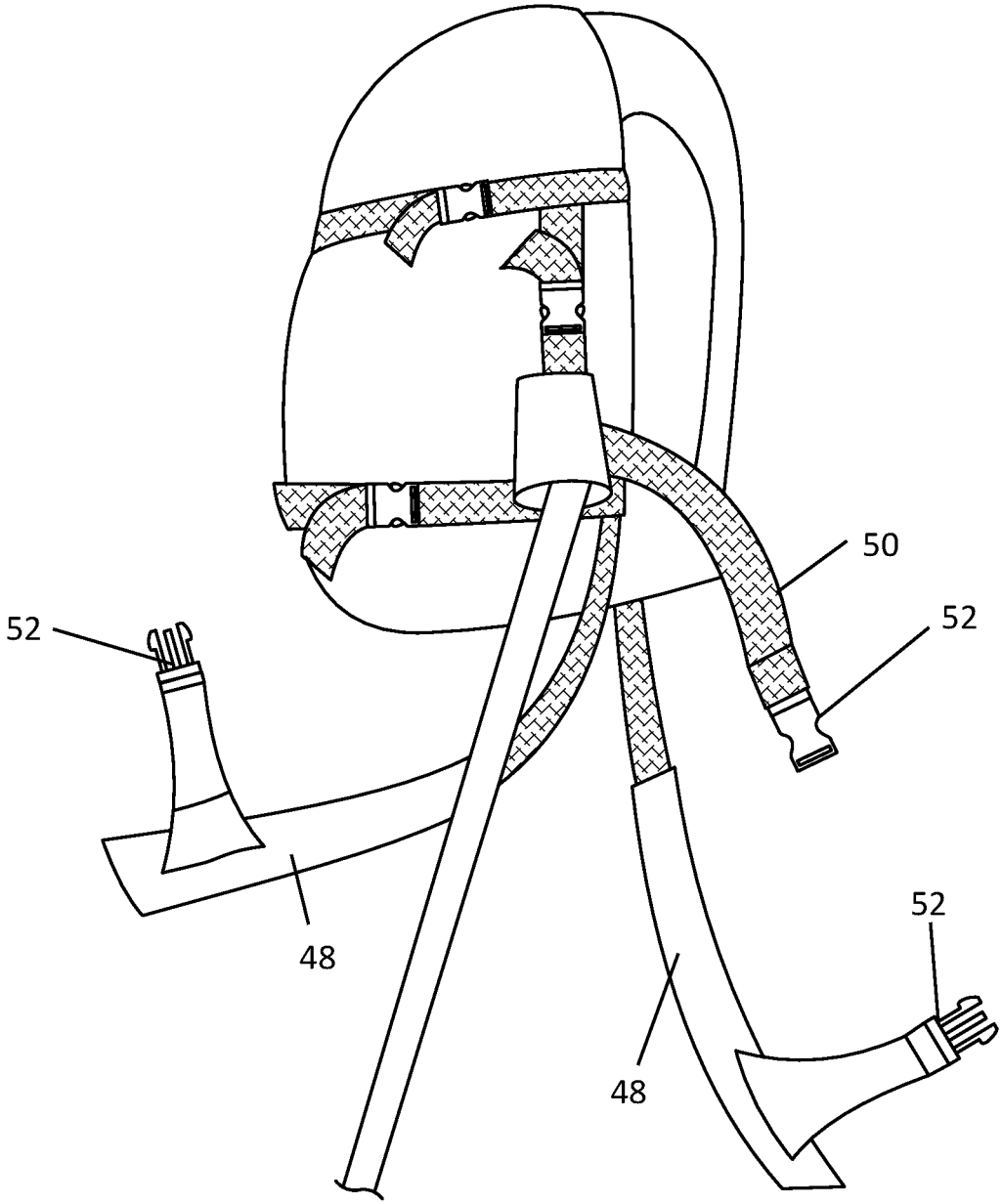
FIG. 9 is a side view of the embodiment of the backpack seat illustrated in FIG. 8.

FIGS. 8-9 further illustrates an alternate embodiment of the seat 48. The seat 48 is directly attached to the base of the backpack 46 and attaches to the tethering system 42 by an additional tether strap 50 by a plastic buckle 52. As illustrated in FIG. 9, the seat 48 can include two separate straps that each attach to the backpack 46.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

I claim:

1. A backpack seat and backpack combination:

wherein said backpack seat comprises a tethering system, said tethering system comprises a plurality of tethers configured for attaching to the backpack;

a pair of receiving cups, wherein said receiving cups are attached to said tethering system on opposite sides of said backpack, wherein said receiving cups are each configured for removably receiving a support rod, a seat configured for a user's rear, wherein said seat is attached to said tethering system and extends beneath said backpack when said backpack is worn by a person;

wherein said backpack seat is configured such that when two support rods are positioned with one support rod in each receiving cup and extends to the ground, said backpack seat is configured for at least partially supporting the weight of the person by distributing at least some of the weight of the person and the backpack to the support rods.

2. The backpack seat and backpack combination of claim 1 wherein said tethering system is adjustable such that said backpack seat can attach to varying sizes of backpacks.

3. The backpack seat and backpack combination of claim 1 wherein said seat further comprises hook and loop fasteners configured for attaching to the base of said backpack when not in use.

4. The backpack seat and backpack combination of claim 1 wherein said tethering system further comprises a lower support panel configured for securing said tethering system to the base of said backpack.

5. The backpack seat and backpack combination of claim 4, wherein said seat is configured further comprises hook and loop fasteners configured for storing said seat against said lower support panel.

6. The backpack seat and backpack combination of claim 1, wherein said seat is adjustable in length.

7. The backpack seat and backpack combination of claim 1, wherein said tethering system is integral with said backpack.

8. The backpack seat and backpack combination of claim 1 wherein said tethering system comprises a series of adjustable loop configured to encircle said backpack, wherein said adjustable loops are configured to be tightened to attach said tethering system to said backpack.

9. A backpack seat and backpack seat combination comprising:

a backpack;

a backpack seat attached to said backpack, said backpack seat comprising a tethering system, said tethering system further comprises a plurality of tethers attaching said backpack seat to said backpack, wherein said tethering system is adjustable, a first receiving cup and a second receiving cup, wherein said receiving cups are attached to said tethering system and positioned on opposite sides of said backpack, wherein said receiving cups are configured for receiving a first support rod and second support rod respectively, a seat configured for a person's rear, wherein said seat is attached to said tethering system and extends beneath the backpack such that a person can sit in the seat while wearing the backpack;

wherein backpack and said backpack seat are configured such that when said first support rodis is positioned in said first receiving cup and said second support rod is positioned within said second receiving cup and extend to the ground, said seat is configured for at least partially supporting the weight of a person by distributing at least some of the weight of the person and the backpack to the first support rod and second support rod.

10. The backpack seat and backpack combination of claim 9 wherein said seat further comprises hook and loop fasteners configured for attaching said seat to the base of said backpack.

11. The backpack seat and backpack combination of claim 9 wherein said tethering system further comprises a lower support panel configured for securing said tethering system to the base of said backpack.

12. The backpack seat and backpack combination of claim 11, wherein said seat further comprises hook and loop fasteners configured for attaching said seat to said lower support panel.

13. The backpack seat and backpack combination of claim 9 wherein said backpack seat is configured to be stored in said backpack.

14. The backpack seat and backpack combination of claim 9, wherein said tethering system is integral to said backpack.

15. The backpack seat and backpack combination of claim 9, wherein said seat is adjustable in length.

16. A backpack seat and backpack combination comprising:

a tethering system, said tethering system further comprises a plurality of tethers configured for attaching said backpack seat to said backpack, wherein said tethering system is adjustable;

wherein said tethering system further comprises a lower support panel configured for securing said tethering system to the base of said backpack;

a first receiving cup and a second receiving cup, wherein said receiving cups are attached to said tethering system, wherein said receiving cups are configured for receiving a first support rod and second support rod respectively, wherein said first receiving cup and said second receiving cup are on opposite sides of said backpack;

a seat extending beneath said backpack configured for the person to sit on while wearing the backpack, wherein said seat is attached to said tethering system;

wherein said seat and said tethering system are configured such that when said support rods are positioned in said receiving cups and extend to the ground, said seat is configured for at least partially supporting the weight of a person by distributing at least some of the weight of the user and the backpack to the poles.

17. The backpack seat and backpack combination of claim 16 wherein said backpack seat is configured to be stored in said backpack.

18. The backpack seat and backpack combination of claim 16, wherein said seat is adjustable in length.

19. The backpack seat and backpack combination of claim 16, wherein said seat further comprises hook and loop fasteners configured for attaching said seat to said support panel.

* * * * *